United States Patent [19]

Widdoes

[11] Patent Number: 4,867,707

[45] Date of Patent: Sep. 19, 1989

[54] COAXIAL SHIELD INTEGRATED CONTACT CONNECTOR ASSEMBLY

[75] Inventor: Peter A. Widdoes, Wilmington, Del.

[73] Assignee: W. L. Gore & Associates, Inc., Newark, Del.

[21] Appl. No.: 110,146

[22] Filed: Oct. 19, 1987

[51] Int. Cl.[4] ..... H01R 17/04

[52] U.S. Cl. ..... 439/675; 439/610; 439/701; 439/497

[58] Field of Search ..... 439/43, 44, 49, 50, 439/52, 53, 63, 94, 96, 98, 99, 108, 109, 119, 176, 578–585, 675, 607, 610, 609, 497, 701

[56] References Cited

U.S. PATENT DOCUMENTS

| | | | |
|---|---|---|---|
| 2,557,130 | 6/1951 | McGee et al. | 439/578 |
| 3,488,625 | 1/1970 | Collin | 439/585 |
| 3,761,844 | 9/1973 | Reeder | 439/578 |
| 4,484,792 | 11/1984 | Zengler et al. | 439/578 |
| 4,556,275 | 12/1985 | Hamsher, Jr. | 439/94 |
| 4,611,873 | 9/1986 | Punako et al. | 439/578 |

FOREIGN PATENT DOCUMENTS

| | | | |
|---|---|---|---|
| 2651694 | 5/1977 | Fed. Rep. of Germany | 439/660 |
| 0928473 | 5/1982 | U.S.S.R. | 439/660 |
| 2104312 | 3/1983 | United Kingdom | 439/63 |

OTHER PUBLICATIONS

"Housing Assembly Connector Splice" IBM Technical Disclosure Bulletin, A. Russin, vol. 11, No. 6, p. 669.

*Primary Examiner*—David Pirlot

*Attorney, Agent, or Firm*—Gary A. Samuels

[57] ABSTRACT

For use on individual coaxial and twin axial cables, a shield integrated contact connector with housing and retention means is provided for pluggability onto an array of closely spaced standard male pins in rows on printed circuit boards and other high density grouped signal transmittal configurations. It features signal fidelity through the connector while maintaining compatability with high density mass pluggable signal requirements.

4 Claims, 4 Drawing Sheets

COAXIAL SHIELD INTEGRATED CONTACT CONNECTOR ASSEMBLY

BACKGROUND OF THE INVENTION

Over the past two decades, computer equipment and associated peripheral equipment have evolved through higher data processing rates into more standardized packaging techniques. System packaging which involves not only interconnections of integrated circuits to printed circuit boards but also printed circuit boards to other printed circuit boards and then to the outside world has evolved into a somewhat standard format. Printed circuit boards can be connected together with either a third printed circuit board (motherboard or backplane) and two connectors or a flexible cable with connectors at each end. The most popular of these connectors is now the post and socket type of connector, a two-piece connector. High reliability and standardized design have contributed to this current popularity. The most common configuration used for the male half of this connector is the 0.025 inch square wire wrap post placed on a 0.100 inch by 0.100 inch grid.

However, high speed digital and analog signal processing systems normally require coaxial grade connections between printed circuit boards or between a printed circuit board and the outside environment. The use of standard radio frequency (RF) type coaxial connectors in this type of packaging system is not desirable or practical because of exposed metal parts which provide opportunity for circuit damaging electrical shorts and because of their size incompatability with the high signal density requirements of the equipment.

Various methods and equipment have been devised to overcome the difficulties outlined above of connecting a printed circuit board with another piece of computer or other electronic equipment by means of coaxial cables. A shielded coaxial ribbon cable assembly which utilized curing inside the assembly curable elastomeric insulation to protect the joined conductive parts was devised by Tighe, Jr. in U.S. Pat. No. 4,596,432. A latching two-part nylon housing system to connect single or twin coaxial cables to a printed circuit board has one housing part secured to the board and the second part, into which the coaxial cables are plugged, latches onto the first part to effect attachment as shown by Smith in U.S. Pat. No. 4,008,941. The device does not use miniaturized standard post and socket hardware, however.

Another way to try to minimize signal distortion in a connector is described by Abraham, et al., in U.S. Pat. No. 3,958,852, by use of a housing with a plurality of coaxial jacks, a ground plane, and two sets of contact springs, all mounted within the housing. Each coaxial jack has a tubular element connected to the ground plane and a socket mounted inside the tubular element. Again, this assembly is not used with standardized miniature post and socket hardware.

A square grid to guide coaxial cable terminals into positive indexing with contact pins extending from a circuit board was provided by Uberbacker in U.S. Pat. No. 3,587,028. The grid structure also served as a common ground for the sheilds of the cables. Another connector utilizable for coaxial cables to connect to them to a row of spaced posts was shown in U.S. Pat. No. 3,569,900. This connector has common grounding for the coaxial shielding at the rear of the connector and does not show provision of shielding in the area of contact between the signal conductor of a coaxial cable and a pin.

BRIEF DESCRIPTION OF THE PRESENT INVENTION

The coaxial connector of the present invention comprises a female center contact compatible with standard closely spaced male pins arranged in rows or grids and mechanically and electrically attached to the center conductor of the coaxial cable, an insulator surrounding the center contact which isolates the center contact from an outer metal shield which is mechanically and electrically attached to the coaxial cable's shield, a female contact mechanically and electrically attached to outside of the metal shell which serves as a contact position to transfer the shielding of the cable to the male post on the printed circuit board, an insulative housing which surrounds the metal shell and ground contact to electrically isolate them from the outside environment and to provide the necessary mechanical alignment from posts not properly aligned for insertion. The connector, which is compatible with standard square or round cross-section non-coaxial pins arranged in the usual grid, preserves the electrical quality of a coaxial transmission system through to a printed circuit board, and maintains compatibility with modern high density mass pluggable signal requirements. Additionally, this connector allows many signals to be simultaneously connected while effectively isolating the ground from the adjacent parts. There are no exposed metal parts to provide an opportunity for circuit-blowing electrical shorts. This connector, a shield integrated contact with housing, is primarily useful for discrete coaxial electrical cables or twin-axial cables rather than ribbon cables, although it can be used for coaxial ribbon cables.

DETAILED DESCRIPTION OF THE PREFERRED EMBODIMENTS

Figure 1:
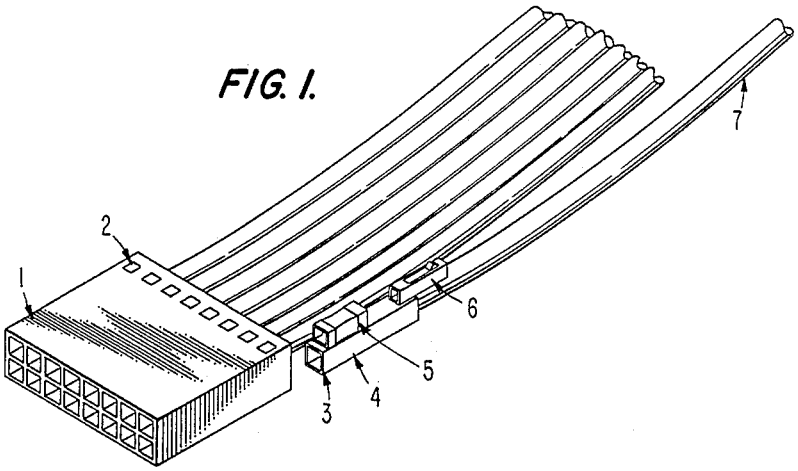
FIG. 1 shows a perspective view of the connector of this invention for eight coaxial cables, seven cables shown plugged into the connector, one cable shown in position for insertion.

Referring now to FIG. 1, the connector assembly of the present invention is described as having an insulating housing 1 into which are mechanically and electrically attached one or more coaxial electric cables 7. One of the coaxial cables 7 is shown in perpective with the shield integrated contact 3 in position to be inserted into the housing 1. The raised tab of the retention device 6 is sized and dimension to fit into one of the snap-lock windows 2 to hold the metal shell 4 which surrounds the insulated signal contact and holds the ground contact 5 in place in housing 1.

Figure 2:
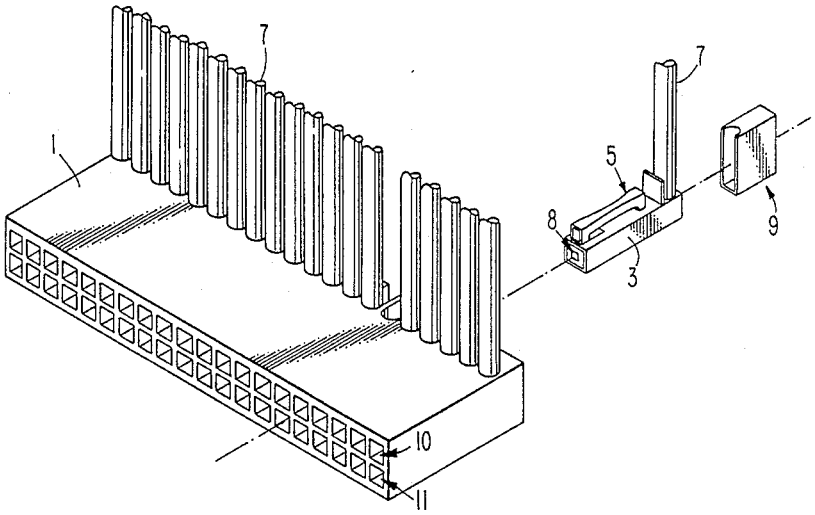
FIG. 2 is an exploded perspective of a right-angled embodiment of the connector of the present invention with a coaxial cable not yet plugged in or end-capped to close the opening in the housing.
Figure 7:
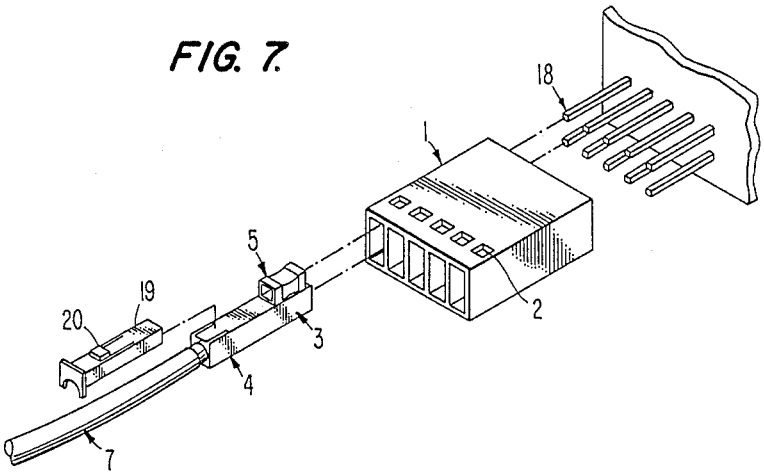
FIG. 7 is an exploded perspective of another embodiment of the invention wherein an insulative locking plug is used to anchor the shield integrated contact in the insulating housing.

The exploded perspective FIG. 2 describes a right-angled embodiment of the shield integrated contact 3. In this embodiment, the coaxial cable 7 enters and is attached to the shield integrated contact 3 at the end opposite the openings for plugging in contact pins to the ground contact 5 and signal contact 8. A small flap in the top of shell 4 of contact 3 is bent upwardly to accommodate cable 7 to facilitate the attachment and that end of contact 3 is covered by end cap 9 when attachment has been completed. Other arrangements and methods may be used instead of the one illustrated to accomodate the exit of coaxial 7 from shield integrated contact 3, particularly when the exit is at an angle from the long axis of shield integrated contact 3. The shield integrated contact 3 is then inserted into plastic housing 1, which displays a ground row 10 and signal row 11 of contact positions for fitting onto an array of appropriately spaced rows of standard post contact pins 18, as shown in FIG. 7.

Figure 3:
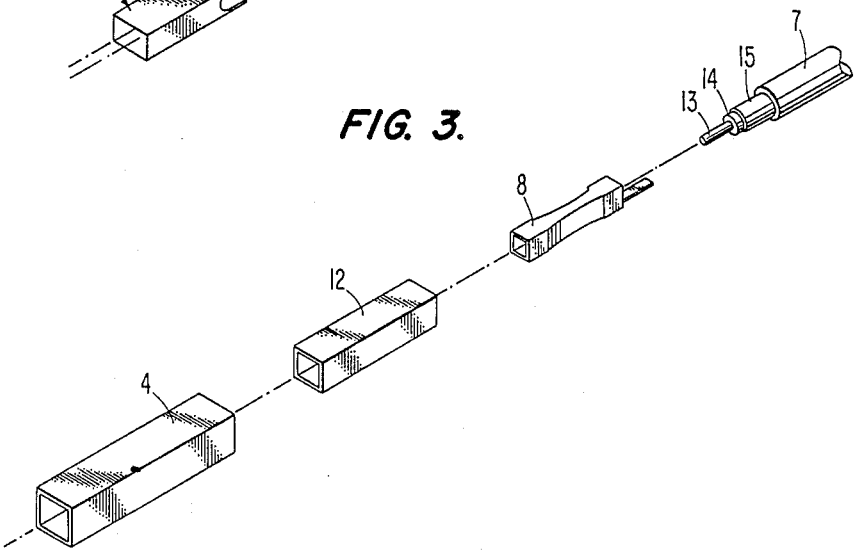
FIG. 3 describes an exploded perpective view of the shield integrated contact.

Shield integrated contact 3 is described in FIG. 3 as a conductive metal shell 4 surrounding a molded plastic insulator 12 which contains, aligned along its center line, a conductive metal signal contact 8. Contact 8 is appropriately attached by soldering, brazing or any other known methods of the art to the center conductor of an electrical coaxial cable 7, which is shown having a typical sequence of conductive center conductor 13, dielectric 14 surrounding center conductor 13, and shield 15 around the dielectric 14.

Figure 4:
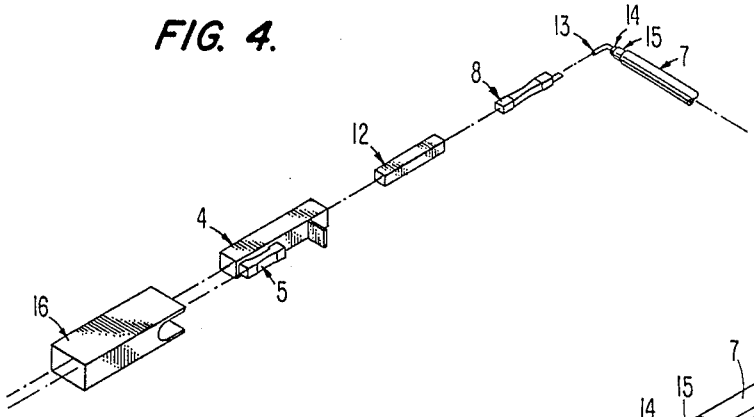
FIG. 4 displays an exploded perspective view of a right-angled embodiment of the shield integrated contact and housing for a single cable.

A similar sequence of parts is shown in FIG. 4 for use of the right-angled embodiment of this invention as a pin-pluggable housed shield integrated contact for a single coaxial cable. In this case, the single cable right-angle housing 16 contains a metal shell 4 which is fitted with an appropriate ground contact 5 as well as a signal contact 8 for plugging onto a pair of standard pin contacts.

Figure 5:
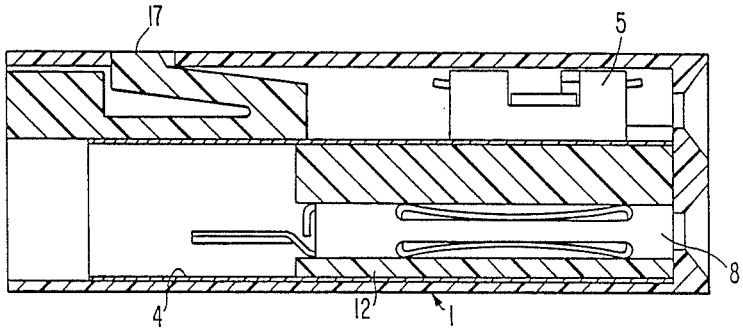
FIG. 5 shows a cross-section of the shield integrated contact locked in its housing.

FIG. 5 shows a cross-section of shield integrated contact 3 in its housing 1, metal shell 4, insulator 12, signal contact 8, ground contact 5, and pin stop 17 for fitting into one of the snap lock windows 2 shown in the housing 1 of FIG. 1 to hold the parts firmly locked together in place, but separable as needed.

Figure 6A:
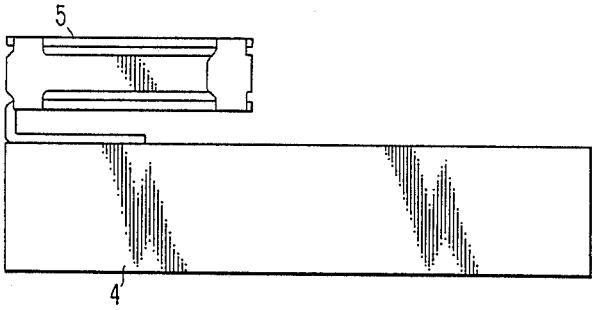
FIGS. 6A and 6B depict both an end and a side view of the outside of the shield integrated contact in scale to show the face of the insulation and the openings into the ground contact and the insulation.
Figure 6B:
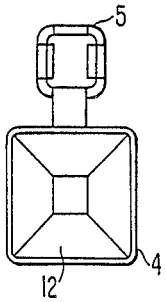

FIG. 6 details an embodiment of the shield integrated contact 3 in side and end view with metal shell 4, ground contact 5, and forward face of the insulator 12.

FIG. 7 is an exploded perspective view of another embodiment of the invention wherein an insulative locking plug 19 is used to anchor shield integrated contact 3 in insulating housing 1. Coaxial cable 7 bearing shield integrated contact 3 is first fitted in housing 1, then plug 19 is inserted in the same slot either above or below cable 7, and snapped into place as tab 20 fits into window 2. The assembled cable and connector may then be plugged onto standard post contact pins 18.

Figure 8:
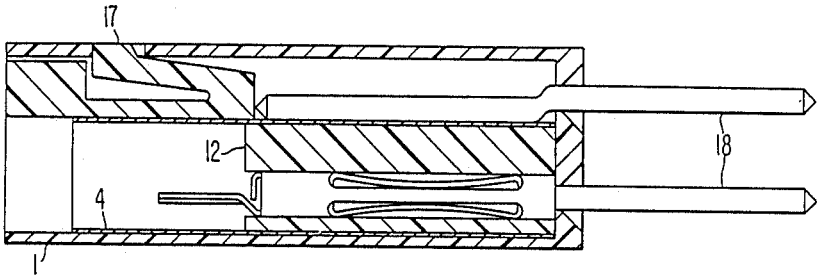
FIG. 8 describes an alternate embodiment of the connector in cross-section where two standard post contact pins are used instead of the female ground and signal contacts shown in FIG. 5.

FIG. 8 is a cross-sectional view of an alternative male version of shield integrated contact 3, where the housing 1, the metal shell 4, the insulator 12, and the pin stop 17 are as previously shown, but standard pins 18 take the place of signal contact 8 and ground contact 5 in order to provide a male alternative connector.

Figure 9:
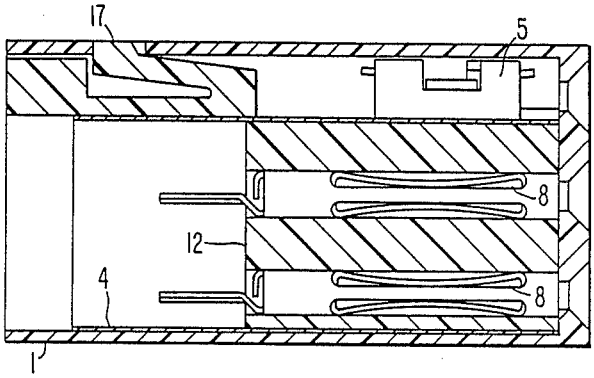
FIG. 9 shows a cross-sectional view of a shield integrated contact for a twin-axial cable.

FIG. 9 shows a similar cross-sectional view to FIG. 5 of a shield integrated contact 3 having two signal contacts 8 and one ground contact 5 for connecting to a twin-axial cable, which has two insulated conductors 13 within one braided shield 15.

Figure 10:
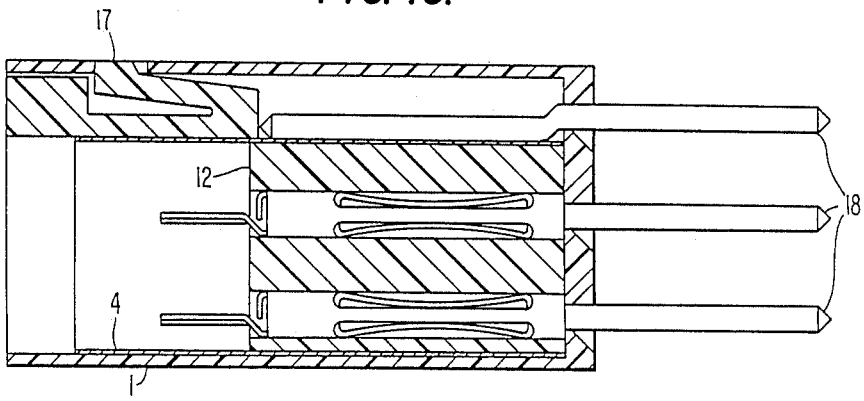
FIG. 10 is a cross-sectional view of the male alternate embodiment of the connector where three standard post contact pins are used in a shield integrated contact for a twin-axial cable.

FIG. 10 is the male alternative form of connector to that shown in FIG. 9 in cross-section for use with twin-axial cable. It is also assumed that one skilled in the art might convert a female connector of this invention to the equivalent male alternative form by insertion of long contact pins into the signal contacts 8 and ground contacts 5, such that adequate excess length of pin protruded from the connector to serve as a standard contact pin of a male form of the connector of this invention.

It will be apparent to those skilled in the art that variuos modifications and variations can be made in the connectors of this invention without departing from the scope and spirit of the invention. Thus, it is intended that the present invention cover the modifications and variations of the invention provided that they fall within the scope of the claims and their equivalents.

I claim:

1. A shield integrated contact connector assembly comprising:
   (a) a twin-axial electrical cable;
   (b) a first female center contact compatible with a standard male contact part and mechanically and electrically attached to one of the two center conductors of said twin-axial electrical cable;
   (c) a second female center contact compatible with a standard male contact part and mechanically and electrically attached to the other center conductor of the twin-axial electrical cable;
   (d) an insulator surrounding said first and second female center contacts;
   (e) an outer conductive metal shell surrounding said insulator, said shell being mechanically attached to the shield of said twin-axial electrical cable;
   (f) a third female contact attached to said outer conductive metal shell;
   (g) an insulative housing surrounding said outer conductive metal shell and said third female contact; and
   (h) a removable retention means for anchoring said metal shell and the attached twin-axial electrical cable to said housing.

2. The shield integrated contact connector assembly of claim 1 in which said removable retention means is physically separable from said housing and said outer conductor metal shell and said third female contact.

3. A coaxial shield integrated contact connector assembly comprising:
   (a) a twin-axial electrical cable;
   (b) a first male standard post contact pin compatible with a female center contact and mechanically and electrically attached to the center conductor of one of said twin-axial electrical cables;

(c) a second male standard post contact pin compatible with a female center contact and mechanically and electrically attached to the other center conductor of the twin axial electrical cable;

(d) an insulator surrounding said first and second male standard post contact pins;

(e) an outer conductive metal shell surrounding said insulator, said shell being mechanically attached to the shield of said twin-axial electrical cable;

(f) a third male standard post contact pin attached to said outer conductive metal shell;

(g) an insulative housing surrounding said outer metal shell and said third male contact pin; and (h) removable retention means for anchoring said metal shell and the attached twin-axial electrical cable to said housing.

4. The shield integrated contact connector assembly of claim 3 in which said removable retention means is physically separable from said housing and said outer conductive metal shell and said third male standard post contact.

* * * * *